United States Patent [19]

Teeter et al.

[11] 4,451,030

[45] May 29, 1984

[54] DOCUMENT STORAGE CHAMBER FOR COUPLING ASYNCHRONOUSLY OPERATED DOCUMENT FEEDING DEVICES

[75] Inventors: Dennis P. Teeter, Penfield; Brian R. Ford, Walworth, both of N.Y.

[73] Assignee: Xerox Corporation, Stamford, Conn.

[21] Appl. No.: 334,663

[22] Filed: Dec. 28, 1981

[51] Int. Cl.[3] ..... B65H 3/04; B65H 29/20

[52] U.S. Cl. ..... 271/265; 271/270; 271/188

[58] Field of Search ..... 271/265, 270, 272, 266, 271/188; 226/113-115, 118, 119, 198

[56] References Cited

U.S. PATENT DOCUMENTS

| | | | |
|---|---|---|---|
| 2,732,754 | 1/1956 | Foster et al. | 226/115 |
| 3,177,749 | 4/1965 | Best et al. | 226/118 |
| 3,790,159 | 2/1974 | Hatzmann et al. | 271/265 |
| 3,863,913 | 2/1975 | Hirafuji | 271/265 |
| 3,940,042 | 2/1976 | Keck | 226/118 |
| 3,957,264 | 5/1976 | Bach et al. | 271/287 |
| 3,966,178 | 6/1976 | Komada et al. | 271/265 |
| 4,009,957 | 3/1977 | Suzuki et al. | 355/14 SH |
| 4,025,187 | 5/1977 | Taylor et al. | 355/14 SH |
| 4,242,167 | 12/1980 | Hoffmann | 226/115 |
| 4,300,756 | 11/1981 | Danchak et al. | 271/265 |

FOREIGN PATENT DOCUMENTS 54-13934 6/1979 Japan .

*Primary Examiner*—Bruce H. Stoner, Jr.
*Assistant Examiner*—James E. Barlow
*Attorney, Agent, or Firm*—Frederick E. McMullen

[57] ABSTRACT

An intermediate document storage chamber permitting coupling of two asynchronously operated document input and output devices together, the storage chamber having flexible guide members for bowing or arcing the portion of the document in the chamber, and control responsive to the level of the document portion in the chamber to control operation of the document input device to assure a continuous supply of document material to the document output device.

6 Claims, 4 Drawing Figures

DOCUMENT STORAGE CHAMBER FOR COUPLING ASYNCHRONOUSLY OPERATED DOCUMENT FEEDING DEVICES

The invention relates to a document handling apparatus and more particularly to an intermediate document storage chamber for operatively coupling asynchronously operated document input and output devices.

In document processing systems where for example the system document processor relies upon a document feeder to maintain a supply of documents to the document processor, it is often difficult to effectively interrelate operation of the document processor with the document feeder reliably. Usually this is due to the fact that the operating speed or rate of the document processor is less than that of the document feeder as for example in applications where the document processor operation is made responsive to demand. As a result, in these applications, intermittent operation of the document feeder is necessary if an oversupply of documents at the document processor is to be avoided.

On the other hand, the operating strength of the processor feeder is less than that of the document feeder. Accordingly, if the supply of document material is inadequate, since the document processor feeder is incapable of overpowering the document feeder, slippage will occur between the document and the document processor feeder. To avoid this, there must always be an adequate supply of document material available to the document processor feeder with drag on the document at a minimum.

Additionally, a device designed to function as an intermediate part of a document handling system must like the aforementioned document processor and document feeder operate with the utmost reliability in the face of a wide range of document sizes and thicknesses and without damaging the documents passing therethrough. This is especially critical when the intermediate device is also relied upon to guide or lead the document into operative relationship with the document processor.

The present invention is intended to provide a document handler in the form of an intermediate document storage chamber to reliably couple two divergently operating document handling or processing devices together, and accordingly the invention relates to a document storage chamber for temporarily storing portions of a document in accommodation of divergent speeds between document feeders at the chamber inlets and outlets comprising: means forming a flexible support for the portion of the document in the chamber, the flexible support permitting the document portion in the chamber to rise and fall in accordance with the amount of the document portion present in the chamber; a sensor for sensing the level of the document portion in the chamber; and control means for starting and stopping the inlet document feeder in response to preset mninimum and maximum levels of the document portion in the chamber.

IN THE DRAWINGS

Figure 1:
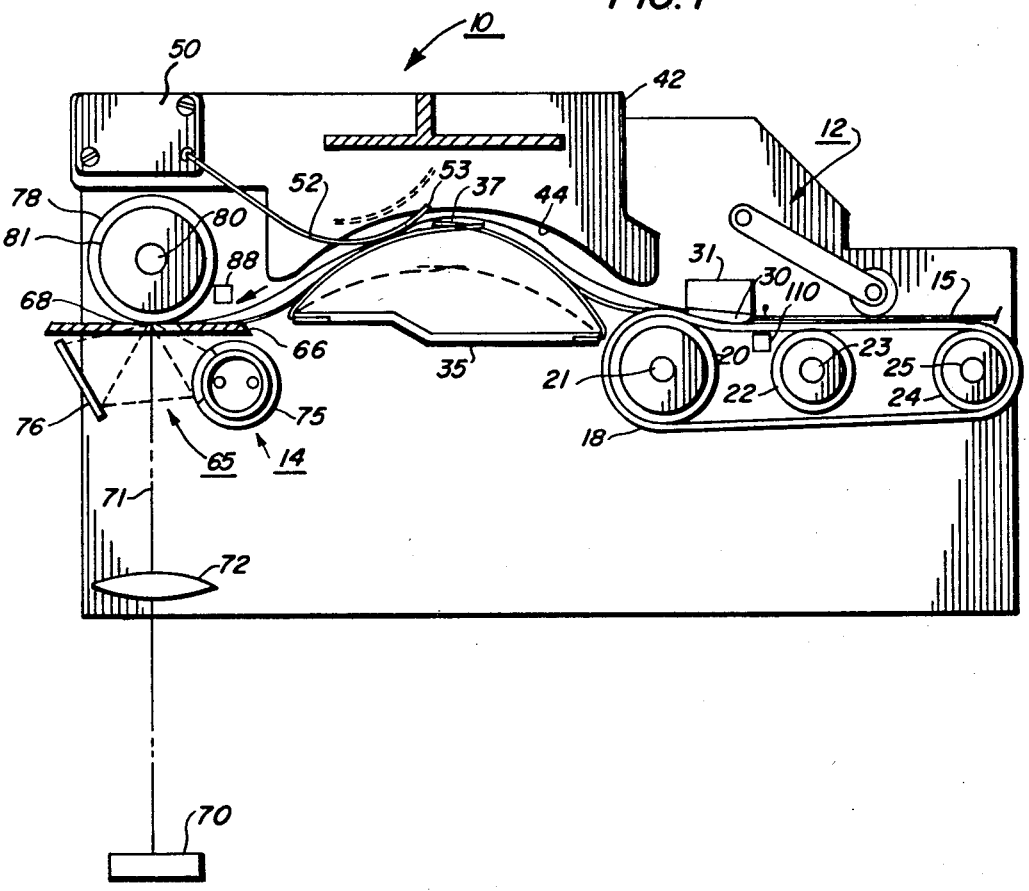
FIG. 1 is a schematic side view of the document storage chamber of the present invention with associated asynchronously operated document input and output devices.
Figure 2:
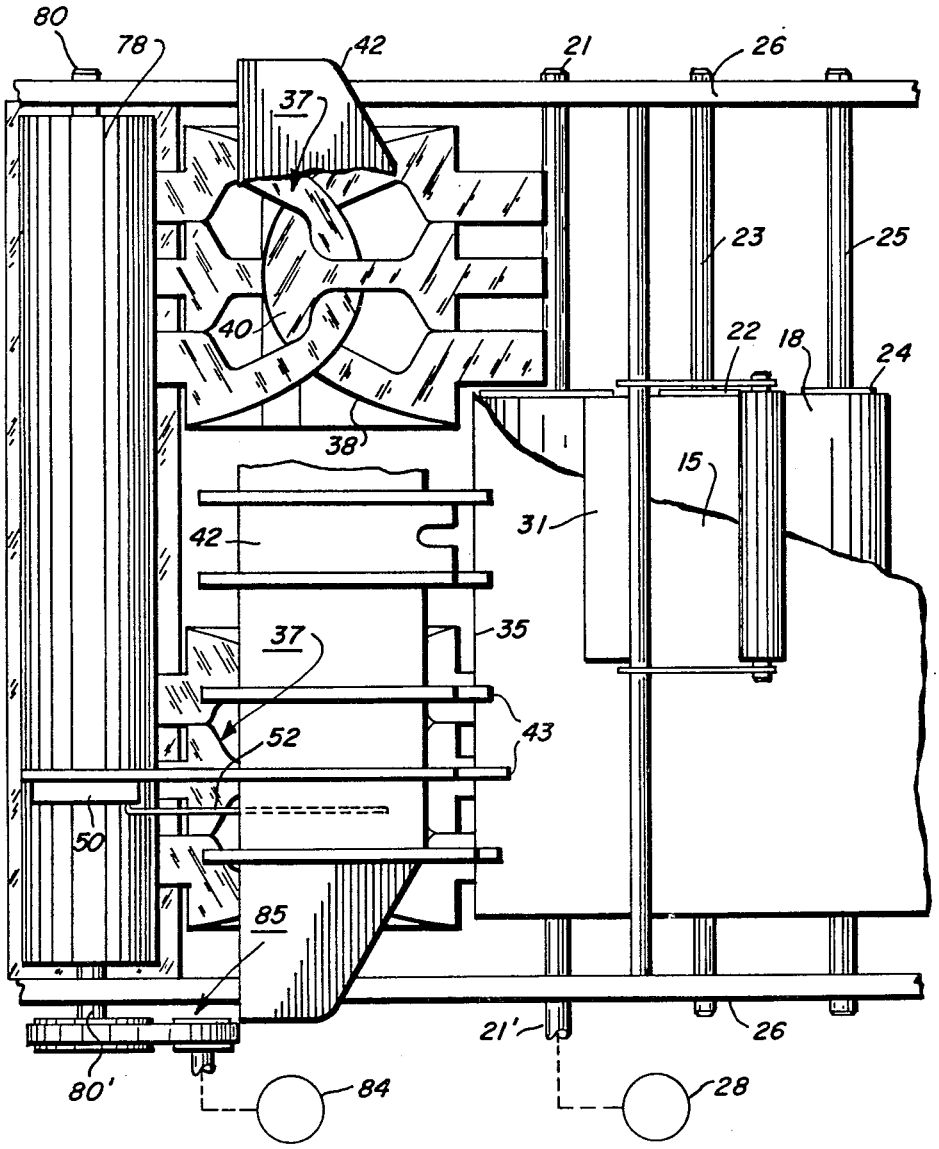
FIG. 2 is a top plan view of the apparatus shown in FIG. 1.

Referring to FIGS. 1 and 2 of the drawings, there is shown the document storage chamber 10 of the present invention. Document storage chamber 10 is adapted to bridge the gap between and to operatively couple two independently operated document input and output devices illustrated herein as document feeder 12 and raster input scanner 14, the latter incorporating a document transport roll 78 as will appear. Document input and output devices other than those illustrated herein may however be readily envisioned. Preferably, the document input device, i.e. document feeder 12, feeds documents 15 at a rate in excess of the rate in which the document output device, here raster scanner 14, utilizes or processes the document.

Referring particularly to FIGS. 1 and 2, document feeder 12 includes a document feed belt 18 stretched about drive roll 20 and idler rolls 22, 24 respectively. Support shafts 21, 23, 25 of rolls 20, 22, 24 are suitably journaled for rotation in a pair of side frame members 26, one end of shaft 21 of roll 20 being extended at 21' to permit coupling thereof with drive motor 28. To prevent feeding of more than one document at a time, a retard pad 30 comprised of suitable frictional material such as rubber, is disposed in operative relationship with feed belt 18 adjacent the outlet of document feeder 12. Retard pad 30 is supported in operative position by cross member 31 which in turn is suitably attached to side members 26. A suitable document supply sensor 110 which may for example comprise a combination light and photocell is provided to sense the presence of documents 15 on feed belt 18 of document feeder 12.

Document storage chamber 10 includes a base member 35 fixedly attached by suitable means to side frame members 26. Spaced pairs of flexible support members 37, which are preferably formed from a suitable plastic material, are attached by suitable means (not shown) to the opposing side edges of base member 35, each support member 37 being comprised of a plurality of continuous finger-like elements 38 projecting through and into overlapping relationship with the finger elements 38 of the opposing support member 37. The terminal ends of flexible fingers 38 are semi-circular in shape to form in cooperation with the opposing flexible fingers a central area 40 for supporting the document in chamber 10. The overall axial length of members 37 is greater than the width of base member 35 so that each support member 37 is forced through the interconnection therebetween and because of the resiliency thereof to assume an upwardly projecting curved arc.

To guide the document entering chamber 10 and control movement of the document in chamber 10, an upper guide 42 comprised of a plurality of individual spaced guide elements 43 is disposed across the width of chamber 10. Upper guide 42 is supported by side frame members 26. The lower face 44 of each guide element 43 is concave to present a smooth uninterrupted arcuate guide surface to the document leading edge as the document passes through document support chamber 10 to scanner 14.

A document height sensor 50 such as a microswitch is provided, sensor 50 being suitably secured to an extended one of the guide elements 43 such that feeler arm 52 thereof projects into chamber 10 and onto one of the flexible support members 37. To obviate possible interference with the document leading edge, the terminal end 53 of feeler arm 52 is curved upwardly. As will appear, feeler arm 52 responds to the height of the document segment in chamber 10 to operate sensor 50 to control the supply of document material in chamber 10.

Raster scanner 14 includes a platen 66 having a relatively flat surface across which documents 15 to be scanned are moved in the direction shown by the solid line arrow. A slit-like scanning aperture 68 is provided in platen 65, the longitudinal axis of aperture 68 extending in a direction subtantially perpendicular to the direction of movement of the document 15.

A suitable scanning array 70 such as a Fairchild Corporation Model 121-H linear array, is provided for scanning the document image line by line as the document passes across aperture 68. Array 70 is disposed so that the scaning axis thereof is substantially parallel to the axis of scanning aperture 68. The optical path between scanning aperture 68 and array 70 (designated by the numeral 71) includes a lens 72 for focusing the document images viewed by array 70 through aperture 68 onto the array 70. A lamp 75 disposed below platen 65 and to one side of the optical path 71 illuminates aperture 68 and the portion of the document image thereover. To enhance illumination, a reflector 76 is disposed on the other side of the optical path 71 across from lamp 75, reflector 76 serving to reflect light emitted by lamp 75 into the aperture area. A pixel clock 105 (FIG. 3) provides suitable clock pulses for operating array 70 in a manner known to those skilled in the art.

Scanner 14 includes document transport roll 78, roll 78 comprising an internal core member or shaft 80, which is normally metal, with a rubber sleeve 81 thereabout. Sleeve 81 is preferably formed from a relatively hard durometer rubber material to insure uniform friction and provide long life. Shaft 80 is rotatably journaled in side frame members 26. One end 80' of shaft 80 is extended and coupled to a suitable drive motor such as step motor 84 by means of belt and pulley drive means 85. Document transport roll 78 is supported so as to form in cooperation with platen 65 a nip adjcent the upstream edge of aperture 68 between which the document 15 to be scanned passes. A suitble document presence sensor such as a combination light and photocell 88 is provided to sense the presence of a document 15 at a point upstream of the nip formed by platen 65 and document transport roll 78.

Figure 3:
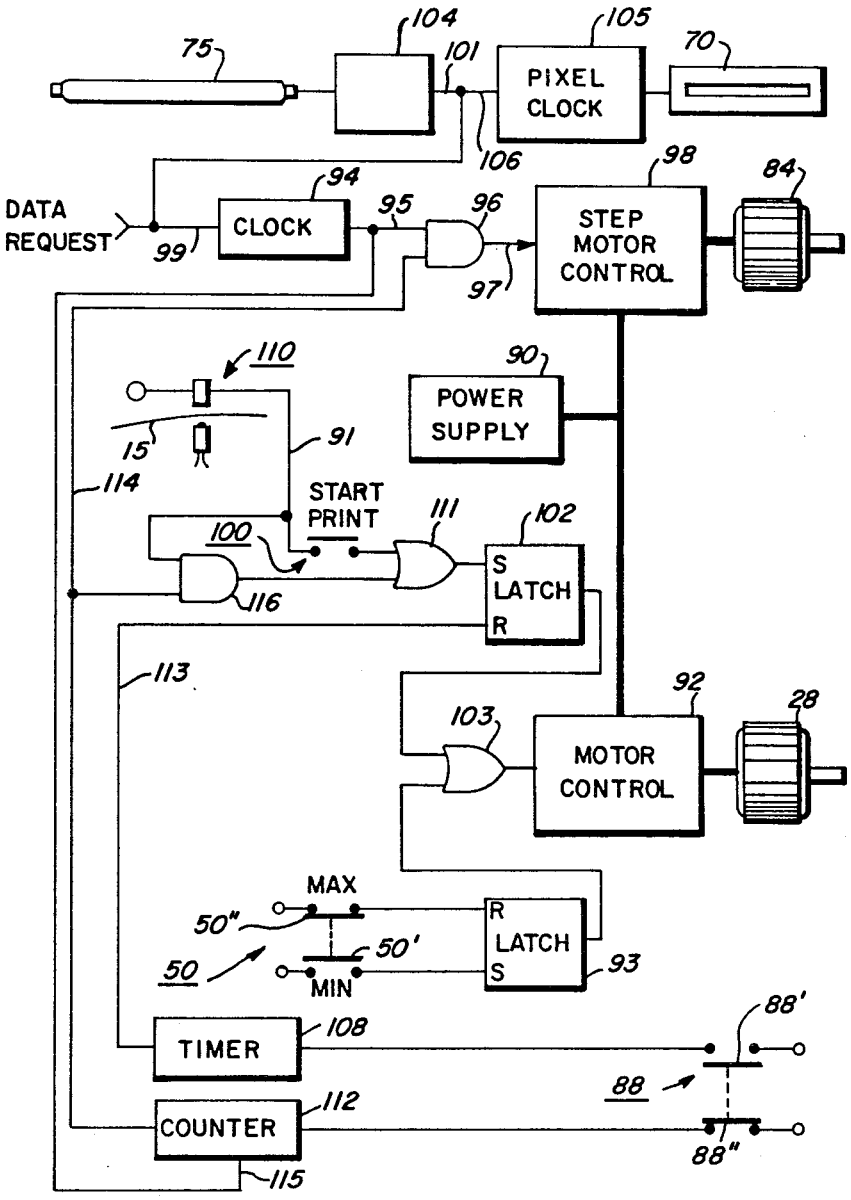
FIG. 3 is a logic diagram in block form illustrating a control system for the document storage chamber shown in FIG. 1.

Referring now to FIG. 3, a suitable power supply 90 is provided for operating drive motor 28 of document feeder 12 and step motor 84 of raster scanner 14. Operation of drive motor 28 is controlled by signals from latches 93, 102 which are coupled through OR function gate 103 to a suitable motor controller 92. Controller 92 serves to couple motor 28 with power supply 90 in response to a control signal from latch 93 or 102.

Latch 93 is controlled in accordance with the supply of document material in chamber 10 as sensed by document height sensor 50, closure of contact 50' of sensor 50 reflecting a predetermined low (i.e. MIN) supply of document material in chamber 10 while closure of contact 50" thereof reflects either a preset maximum (i.e. MAX) supply of document material in chamber 10 or expansion of flexible support members 37 to a maximum height. As will be understood, flexible support members 37 are free to expand in the absence of any document material in chamber 10 or on release of tension on the document material as is occasioned for example by passing of the document trailing edge out of the nip formed by document feed belt 18 and retard pad 30.

A suitable operator control, exemplified herein by Start/Print switch 100, is coupled through OR function gate 111 to the set input terminal of latch 102. Start/-Print switch 100 is enabled by a signal from document supply sensor 110 through line 91 on the disposition of one or more documents in document feeder 12.

Contact 88' of document sensor 88 is coupled to the control input of a suitable timer 108, closing of contact 88' in response to the passage of the leading edge of the document being fed across sensor 88 serving to actuate timer 108. Timer 108, which may comprise any suitable timing mechanism, functions when actuated to toll a preset timed interval designed to allow document feed belt 18 to advance the leading edge of the document being fed forward from sensor 88 into the nip formed by platen 65 and document roll 78 of scanner 14. The output side of timer 108 is coupled to the reset terminal of latch 102 through line 113.

Contact 88" of document presence sensor 88 is coupled to the control input of decrementing counter 112, closure of contact 88" upon passage of the trailing edge of the document being fed past sensor 88 serving to actuate counter 112. Counter 112, which may comprise any suitable counting mechanism, is preset to a count equal to the number of steps required to advance the remainder of the document being fed (i.e. the portion of document 15 remaining between sensor 88 and the nip formed by platen 65 and document feed roll 78 of scanner 14) to scanner 14 after the document trailing edge passes sensor 88. Counter 112, when actuated, is driven by the stepping pulses output by a suitable clock 94 through line 115. The signal output side of counter 112 is coupled by line 114 to one terminal of an AND function control gate 96 and to an AND function gate 116. A second input terminal of gate 116 is coupled to document supply sensor 110 through line 91. The output of gate 116 is coupled to the set input of latch 102 through gate 111.

To provide step-like operation of feed roll 78, clock 94, which when actuated outputs a series of timed stepping pulses, is coupled by line 95 to control gate 96. As described, a second input of control gate 96 is coupled by line 114 to the output of counter 112. The output terminal of control gate 96 is coupled through line 97 to a suitable step motor controller 98 effective on each stepping pulse from clock 94 to cause step motor 84 to operate through one step. Each step of motor 84 rotates document transport roll 78 by a predetermined amount.

Clock 94 is actuated on a demand for image data by the data recipient which may for example comprise a storage memory, data communication channel, etc. The demand for data (DATA REQUEST) is input through line 99. A demand for image data (DATA REQUEST) in line 99 additionally serves to trigger a suitable lamp energizing circuit 104 to energize lamp 75 and to start pixel clock 105 to operate scanning array 70.

In operation with both chamber 10 and document feeder 12 empty, flexible support members 37 are in the raised position shown by solid lines in FIG. 1 of the drawings. Feeler arm 52 of sensor 50, which rests on one of the flexible members 37, accordingly closes sensor contact 50" (MAX).

Disposition of one or more documents 15 to be scanned on feed belt 18 of document feeder 12 is sensed by document supply sensor 110 enabling operation of the system. Actuation of Start/Stop switch 100 by the operator or user sets latch 102. The signal output of latch 102 actuates motor control 92 to energize drive motor 28 of document feeder 12. Energization of motor 28 drives, through roll 20, belt 18 of document feeder 12 to advance the bottommost document forward under retard pad 30 and into document storage chamber 10. As the document is fed forward, the document leading edge rides up on the curved surface of flexible support members 37 and under feeler arm 52 of switch 50. Contained feeding of the document by document feeder 12 advances the document leading edge to sensor 88, where the document leading edge is sensed closing contact 88' and opening contact 88". Closure of sensor contact 88' starts timer 108 which following a predetermined timed interval sufficient for the document leading edge to reach the nip formed between platen 65 and document transport roll 78, times out to terminate operation of motor 28.

On a demand for image data, clock 94 is triggered by the signal (DATA REQUEST) in line 99. Clock 94 outputs timed stepping pulses to step motor controller 98 to repeatedly actuate step motor 84 and step document transport roll 78. As will be understood, the degree of rotational movement of roll 78 for each step is determined by the width of the stepping pulses output by clock 94, each step being the equivalent of one scanline. Concurrently, the signal (DATA REQUEST) in line 99 starts pixel clock 105 to operate scanning array 70 and scan the document image line opposite aperture 68. Additionally, the signal (DATA REQUEST) triggers lamp energizing circuit 104 to energize lamp 75 and illuminate the document line.

As the document material is stepped forward by document transport roll 78, the amount of document material in chamber 10 decreases foreshortening the length of the document material in chamber 10. With shortening of the document length in chamber 10, the height of the document material in chamber 10 decreases against the bias imposed by flexible support members 37. Feeler arm 52, which rides on the document, senses the decrease in document height and on a predetermined decrease in document height, closes contact 50' (MIN) of sensor 50 while opening contact 50". Closure of contact 50' sets latch 93 to energize motor 28 and operate document feed belt 18 to advance to document forward.

Inasmuch as the feeding rate of document feeder 12 is greater than the scanning rate of scanner 14, the document being scanned is overfed leading to the creation of an ever larger loop of document material in chamber 10. As the height of the document loop in chamber 10 increases, feeler arm 52 of sensor 50 moves upwardly and on attainment of a predetermined document height, contact 50' (MAX) is closed. Closure of contact 50" resets latch 93 deenergizing motor 28 to terminate document feed.

The foregoing process continues until the trailing edge of the document 15 passes through the nip formed by feed belt 18 and retard pad 30. Once clear of the nip, the trailing edge of document 15 traverses over the raised flexible support members 37 until the trailing edge of the document 15 passes by sensor 88, contact 88" is closed enabling counter 112. As a result, each subsequent stepping pulse output by clock 94 decrements counter 112 by one. On counter 112 reaching a count of zero, a signal from counter 112 disables control gate 96 to terminate operation of step motor 84. At the same time, the signal from counter 112 cooperates with the signal from sensor 110 to reset latch 102 and enable feeding of the next document on feed belt 18 forward in the manner described.

Figure 4:
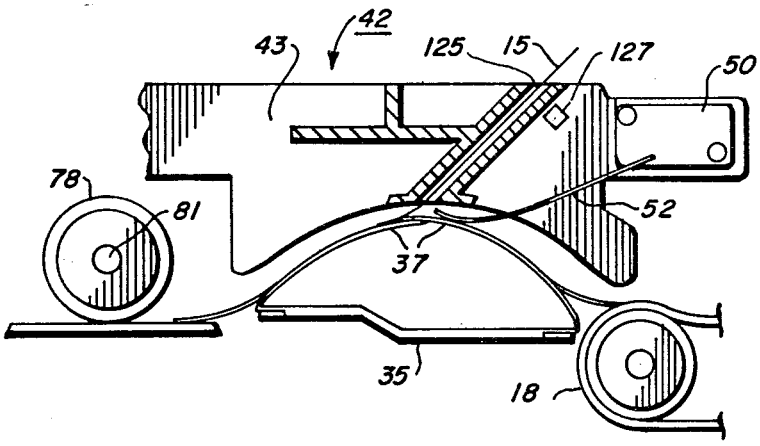
FIG. 4 is a partial side view illustrating an alternate document storage chamber construction.

In the embodiment shown in FIG. 4 of the drawings, where like numbers refer to like parts, a downwardly inclined slot-like aperture 125 is provided in upper guide 42, aperture 125 preferably extending across the operating width of chamber 10. Aperture 125 permits manual insertion of documents 15 into the chamber 10 and the nip formed by platen 65 and document transport roll 78 by the operator or user.

In this embodiment, the position of document height sensor 50 and feeler arm 52 thereof is changed so that feeler arm 52 is on the upstream side of aperture 125 to avoid actuation of document feeder 12 in response to the manual loading of a document through aperture 125. To assure disabling of document feeder 12 and prevent upwarranted actuation of feeder 12 in the event documents are disposed on document feed belt 12 during manual operation, a suitable sensor 127 is disposed in operative relation to aperture 125 to sense the presence of a document therein. Sensor 127 is electrically connected to disable the operating control for document feeder motor 28 while enabling operation of raster scanner 14 in response to a demand signal (DATA REQUEST).

While the invention has been described with reference to the structure disclosed, it is not confined to the details set forth, but is intended to cover such modifications or changes as may come within the scope of the following claims.

We claim:

1. A chamber for temporarily storing portions of a document in accommodation of divergent speeds and drive strength mismatch between document feeders at the chamber inlet and outlets comprising:

means forming a flexible support for the portion of the document in said chamber, said flexible support permitting said document portion in said chamber to rise and fall in accordance with the amount of said document portion present in said chamber;

a sensor cooperable with said support and engageable with any document portion supported by said support for sensing the level of said document portion in said chamber; and control means for starting and stopping the inlet document feeder in response to preset minimum and maximum levels of said document portion in said chamber.

2. The chamber according to claim 1 in which said flexible support means comprises a pair of overlapping resilient elements cooperable to form an arced path for supporting the portion of said document in said chamber in operative relation with said sensor.

3. A chamber for temporarily storing portions of a document in accommodation of divergent speeds and drive strength mismatch between document feeders at the chamber inlet and outlets comprising:

means forming a flexible support for the portion of the document in said chamber, said flexible support permitting said document portion in said chamber to rise and fall in accordance with the amount of said document portion present in said chamber;

a sensor for sensing the level of said document portion in said chamber; and control means for starting and stopping the inlet document feeder in response to preset minimum and maximum levels of said document portion in said chamber;

said flexible support means comprising a pair of overlapping resilient elements cooperable to form an arced path for supporting the portion of said document in said chamber in operative relation with said sensor, and plural document guide members disposed in spaced relation above said flexible support elements, said document guide members having a lower curved guide surface cooperable with said flexible support elements to form an arcuate path through which the document entering said chamber passes.

4. A chamber for temporarily storing portions of a document in accommodation of divergent speeds and drive strength mismatch between document feeders at the chamber inlet and outlets comprising:

means forming a flexible support for the portion of the document in said chamber, said flexible support permitting said document portion in said chamber to rise and fall in accordance with the amount of said document portion present in said chamber;

a sensor for sensing the level of said document portion in said chamber; and control means for starting and stopping the inlet document feeder in response to preset minimum and maximum levels of said document portion in said chamber;

said flexible support means comprising a pair of overlapping resilient elements cooperable to form an arced path for supporting the portion of said document in said chamber in operative relation with said sensor, and means to enable said inlet document feeder to be bypassed and permit manual loading of a document into said chamber.

5. In a document feeding system having a document input feeder including means forming a document feeding nip, and a document output feeder including means forming a document feeding nip, the combination of:

(a) a document handling chamber operatively coupling said input feeder with said output feeder;

(b) first document sensing means for sensing the presence of at least one document to be fed in said input feeder;

(c) second document sensing means for sensing the presence of the document being fed at a point upstream of said output feeder nip;

(d) third document sensing means for sensing the portion of the document being fed in said document handling chamber; and (e) control means responsive to said first, second and third document sensing means for controlling operation of said input feeder to feed a document to said output feeder;

said control means including timing means for actuating said input feeder to advance the leading edge of the document being fed past said second document sensing means to said output feeder nip;

said second document sensing means actuating said timing means on sensing the leading edge of the document being fed;

said document handling chamber including biasing means for biasing the document portion therein upwardly whereby on simultaneous disposition of portions of the document being fed in both said input feeder and output feeder nips, actuation of said output feeder while said input feeder is unactuated feeds said document from said chamber reducing the height of the document portion therein against the bias imposed by said biasing means;

said third document sensing means responding to a preset minimum document height to actuate said input feeder to advance an addition portion of the document being fed to said chamber.

6. The system according to claim 5 in which said third document sensing means is operative on a preset maximum document height to terminate actuation of said input feeder to stop advance of said document by said input feeder.

* * * * *